US009366417B2

(12) United States Patent
Eliason et al.

(10) Patent No.: US 9,366,417 B2
(45) Date of Patent: Jun. 14, 2016

(54) INTERNAL DEFLECTION VENTING

(71) Applicant: Phoseon Technology, Inc., Hillsboro, OR (US)

(72) Inventors: Garth Eliason, Portland, OR (US); Gary Till, Newberg, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 29 days.

(21) Appl. No.: 14/308,399

(22) Filed: Jun. 18, 2014

(65) Prior Publication Data

US 2014/0376221 A1 Dec. 25, 2014

Related U.S. Application Data

(60) Provisional application No. 61/837,098, filed on Jun. 19, 2013.

(51) Int. Cl.

| | |
|---|---|
| ***F21V 15/01*** | (2006.01) |
| ***F21K 99/00*** | (2016.01) |
| ***F21V 5/04*** | (2006.01) |
| ***B05D 3/06*** | (2006.01) |

(52) U.S. Cl.

CPC ..... *F21V 15/011* (2013.01); *B05D 3/067* (2013.01); *F21K 9/30* (2013.01); *F21V 5/04* (2013.01)

(58) Field of Classification Search

CPC ... F21V 29/027; F21V 29/2206; F21V 29/00; F21V 29/02; F21V 29/025; F21V 9/027; F21V 9/2212; F21V 29/40; F21V 29/50; F21V 29/503; F21V 29/60; F21V 5/04; F21V 15/011; B05D 3/067; F21K 9/30

See application file for complete search history.

(56) References Cited

U.S. PATENT DOCUMENTS

| | | | | |
|---|---|---|---|---|
| 7,972,036 | B1 | 7/2011 | Schach et al. | |
| 8,294,340 | B2 | 10/2012 | Yu et al. | |
| 8,888,336 | B2 * | 11/2014 | Till | B01F 19/123 29/428 |
| 8,915,624 | B2 * | 12/2014 | Manahan | F21V 29/20 362/373 |
| 2004/0004817 | A1 * | 1/2004 | Greco | H01L 23/467 361/697 |
| 2009/0323324 | A1 | 12/2009 | Liu | |

(Continued)

FOREIGN PATENT DOCUMENTS

WO 2013054996 A1 4/2013

OTHER PUBLICATIONS

Phoseon Technology, FireEdge Product Datasheet FE200/110 Air-Cooled Lamp, Apr. 2012, 2 pages.

(Continued)

*Primary Examiner* — Bao Q Truong

(74) *Attorney, Agent, or Firm* — Alleman Hall McCoy Russell & Tuttle LLP

(57) ABSTRACT

Methods and systems are provided for a lighting module and related components for efficiently directing dissipated heat and/or heated air away from the lighting module. Deflectors are often used to funnel heat away from solid-state light emitters and channel airflow away from a curing surface, but the risk of constrained airflow may negatively affect emitter output as well as disturb the curing process of a workpiece emitted light is directed towards. To efficiently remove heat as well as not disturb the curing process or shape of the lighting module, louvered vents are provided that extend into an interior of a housing of the lighting module for guiding heated air in a deflecting direction away from the emitted light direction.

20 Claims, 8 Drawing Sheets

(56) References Cited

U.S. PATENT DOCUMENTS

2009/0323361 A1* 12/2009 Liu ..... F21V 29/02 362/373
2010/0177514 A1 7/2010 Liu et al.
2010/0328949 A1* 12/2010 Lai ..... F21K 9/00 362/249.02
2013/0021789 A1* 1/2013 Dahm ..... B05D 3/067 362/184
2013/0088869 A1* 4/2013 Yun ..... F21V 29/004 362/249.01

OTHER PUBLICATIONS

ISA Korean Intellectual Property Office, International Search Report and Written Opinion Issued in Application No. PCT/US2014/042995, Oct. 10, 2014, WIPO, 11 pages.

* cited by examiner

INTERNAL DEFLECTION VENTING

CROSS-REFERENCE TO RELATED APPLICATIONS

This application claims priority to U.S. Provisional Patent Application No. 61/837,098, entitled "Internal Deflection Venting," filed Jun. 19, 2013, the entirety of which is hereby incorporated by reference for all purposes.

BACKGROUND AND SUMMARY

Solid-state light emitters, such as light-emitting diodes (LEDs) and laser diodes, have several advantages over using more traditional arc lamps during curing processes, such as ultraviolet (UV) curing processes. Solid-state light emitters generally use less power, generate less heat, produce a higher quality cure, and have higher reliability than traditional arc lamps. While solid-state light emitters emit less heat than their arc lamp counterparts, the temperatures emitted from the solid-state light emitters can still be very high and can cause overheating of the solid-state light emitters during use and damage to the components of the solid-state light emitters over time. Overheating and damage to components of the solid-state light emitters may cause downtime for repair and loss of revenue.

Some solid-state light emitters incorporate cooling systems to remove some of the heat that is generated when the solid-state light emitter emits light. Often, these cooling systems include one or more heat sinks that help remove heat generated by the solid-state light emitters from the housing through openings or other heat exits in the housing, which results in air being expelled from the housing. These openings or heat exits in the housing are generally located near the medium on which the curing process occurs and can cause air to be expelled onto the medium, which can disturb the curing process, and which can increase manufacturing costs and decrease quality and efficiency.

External air deflectors have been used to effectively funnel heat away from solid-state light emitters and channel airflow away from a curing surface. A deflector may be secured to the housing and positioned to extend below some portion of the heat exit, the deflector guiding airflow and waste heat away from the housing. However, the constrained airflow due to an external deflector may negatively affect solid-state light emitter output as the deflector may block heat escape, raise the temperature of a heat sink, and lower LED efficiency. Furthermore, a deflector placed external to a housing for a lighting module may enlarge the housing and/or create an awkward shape that is not conducive to a particular curing system. This enlarged format may cause problems for integration, fitting, or arranging of the lighting module into existing systems.

One approach that may at least partially address the aforementioned issues includes a lighting module, comprising: an array of light-emitting elements thermally and/or electrically coupled to a heat sink and a housing having a plurality of heat exits. The heat exits may be covered over by louvered venting. For example, the louvered venting may guide airflow and waste heat away from the housing in a direction opposite to the direction in which the array of light-emitting elements emit light. In this manner, disturbance of the curing process at the medium by heat expelled from the lighting module can be substantially reduced, thereby increasing the reliability of the curing process, decreasing manufacturing costs, and increasing quality and efficiency. Furthermore, the louvered vents may be punched out of material comprising the housing and may not extend outwardly beyond the plane of the exterior of the housing. In this way, the cost and manufacture of additional components may be saved and the shape and size of the lighting module may remain substantially unaltered.

It will be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION OF THE EMBODIMENTS

Figure 1:
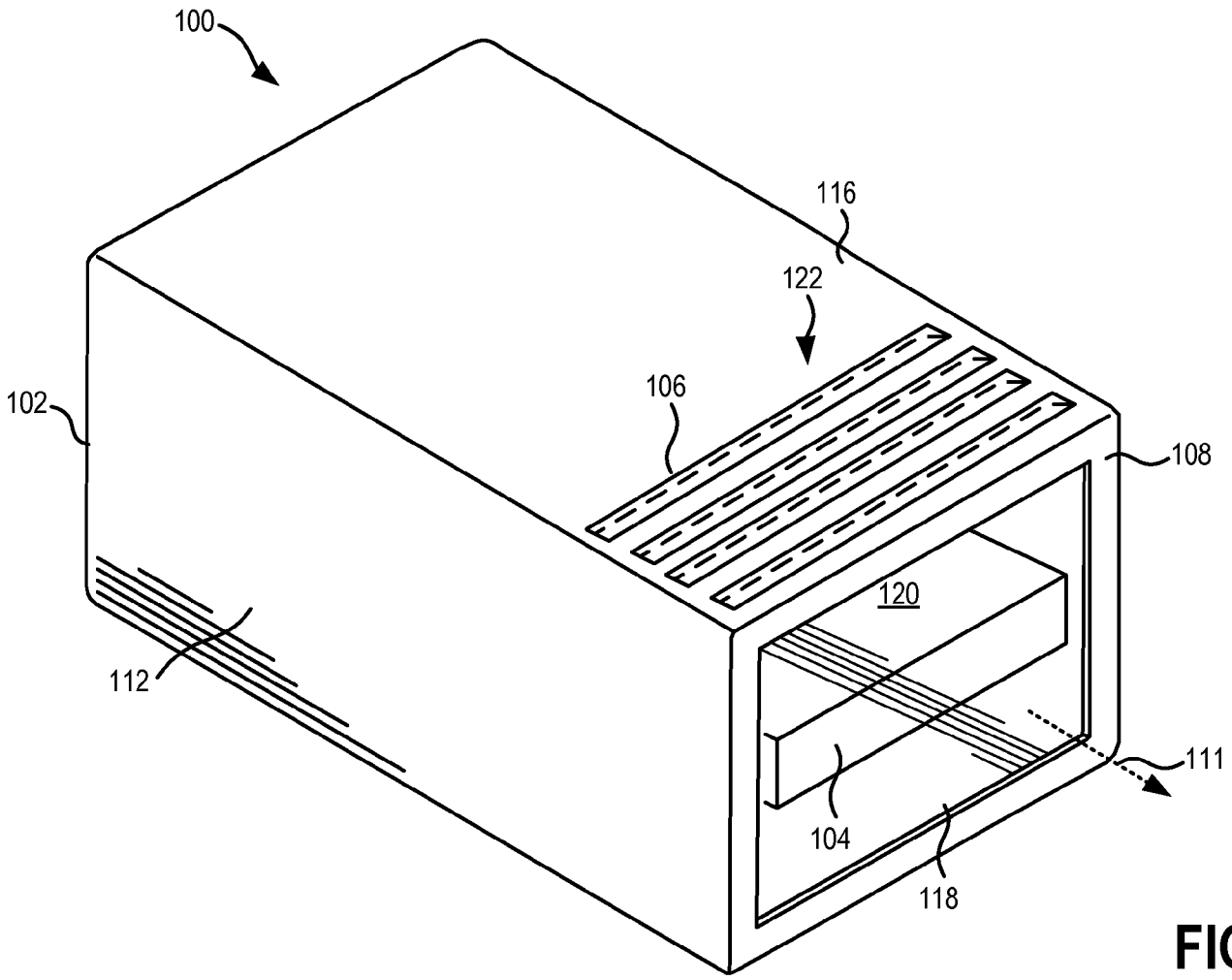
FIG. 1 shows a front perspective view of an example lighting module having louvered vents.
Figure 2:
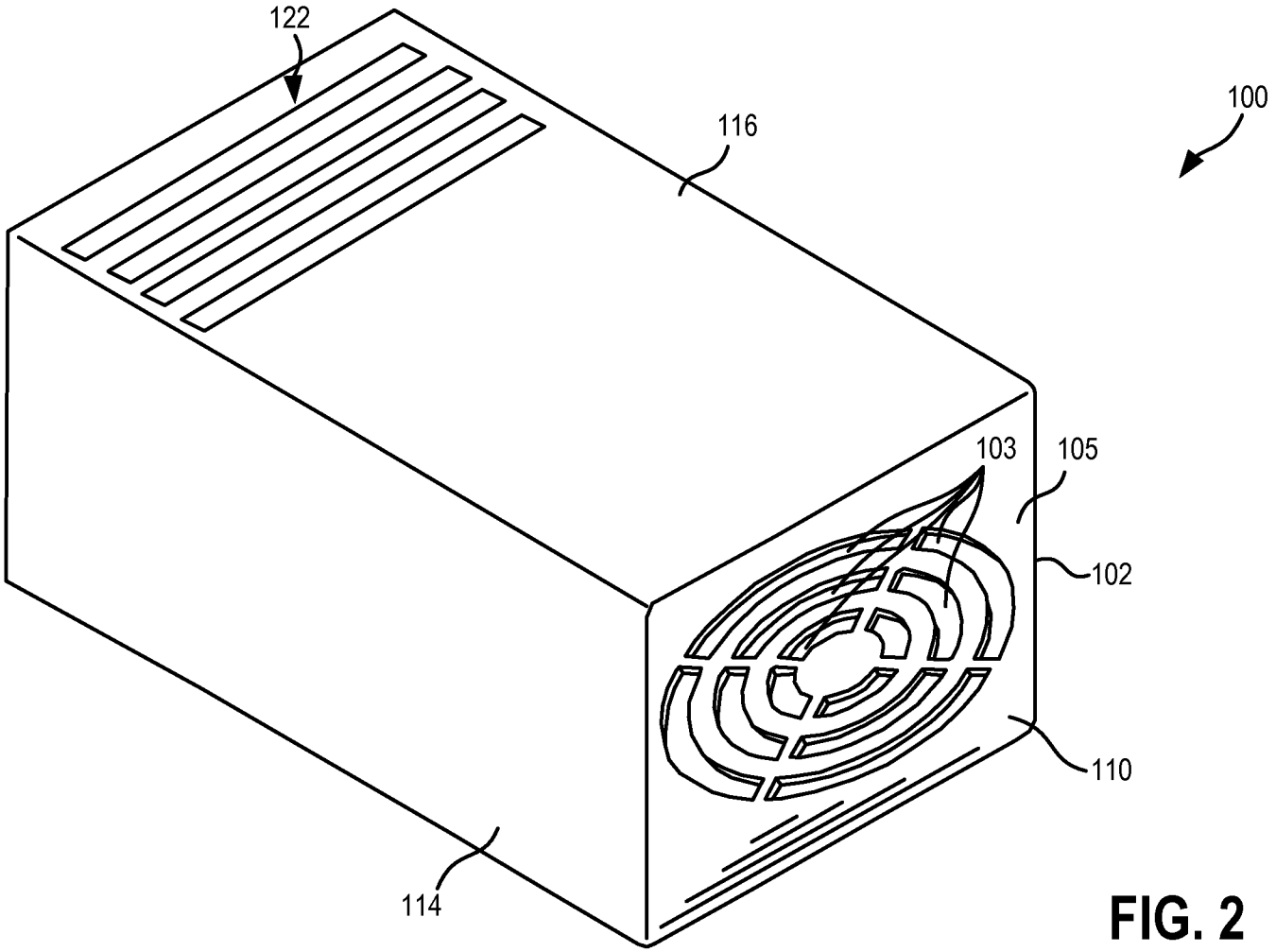
FIG. 2 shows a back perspective view of the example lighting module with the louvered vents shown in FIG. 1.
Figure 3:
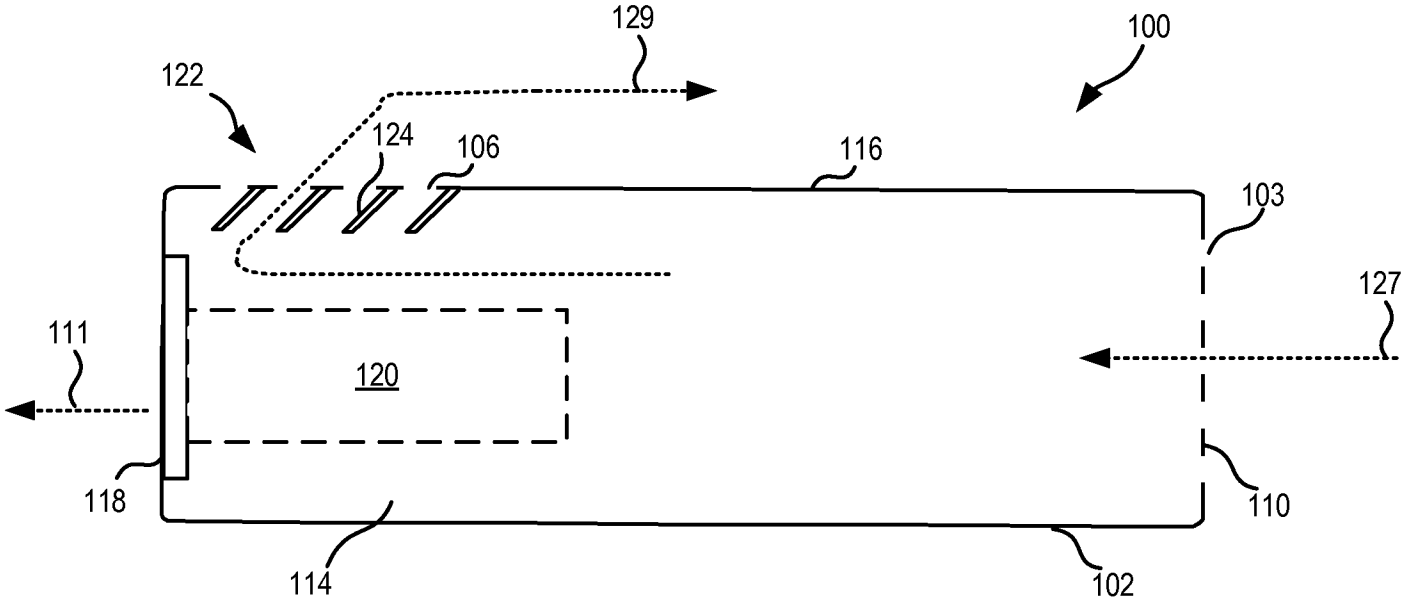
FIG. 3 shows a side view of the example lighting module illustrated in FIG. 1.
Figure 4:
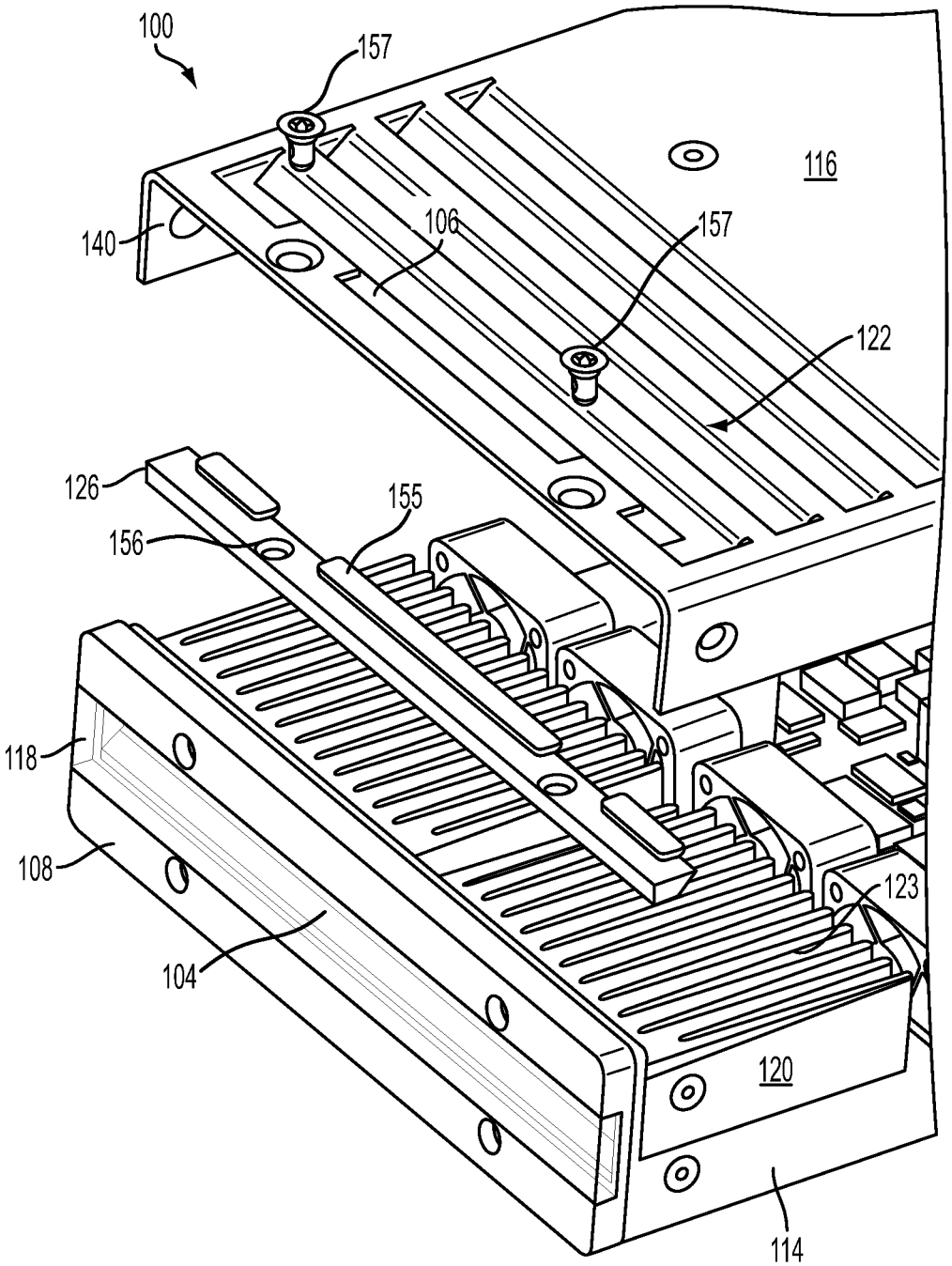
FIG. 4 shows a partial exploded view of example louvered vents and the portion of the lighting module to which it is secured.
Figure 5B:
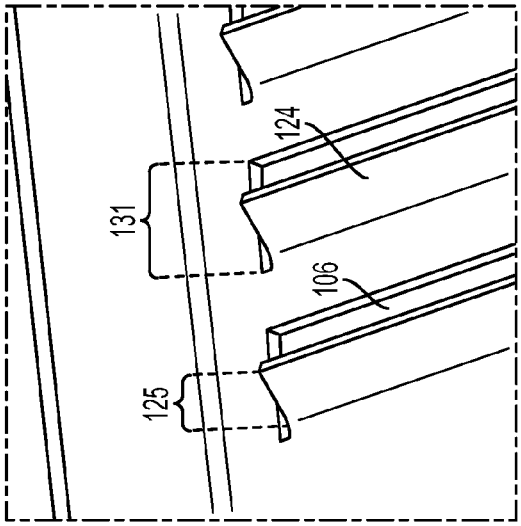
FIGS. 5A and 5B show underside views of a top surface of a lighting module housing comprising louvered vents.
Figure 5A:
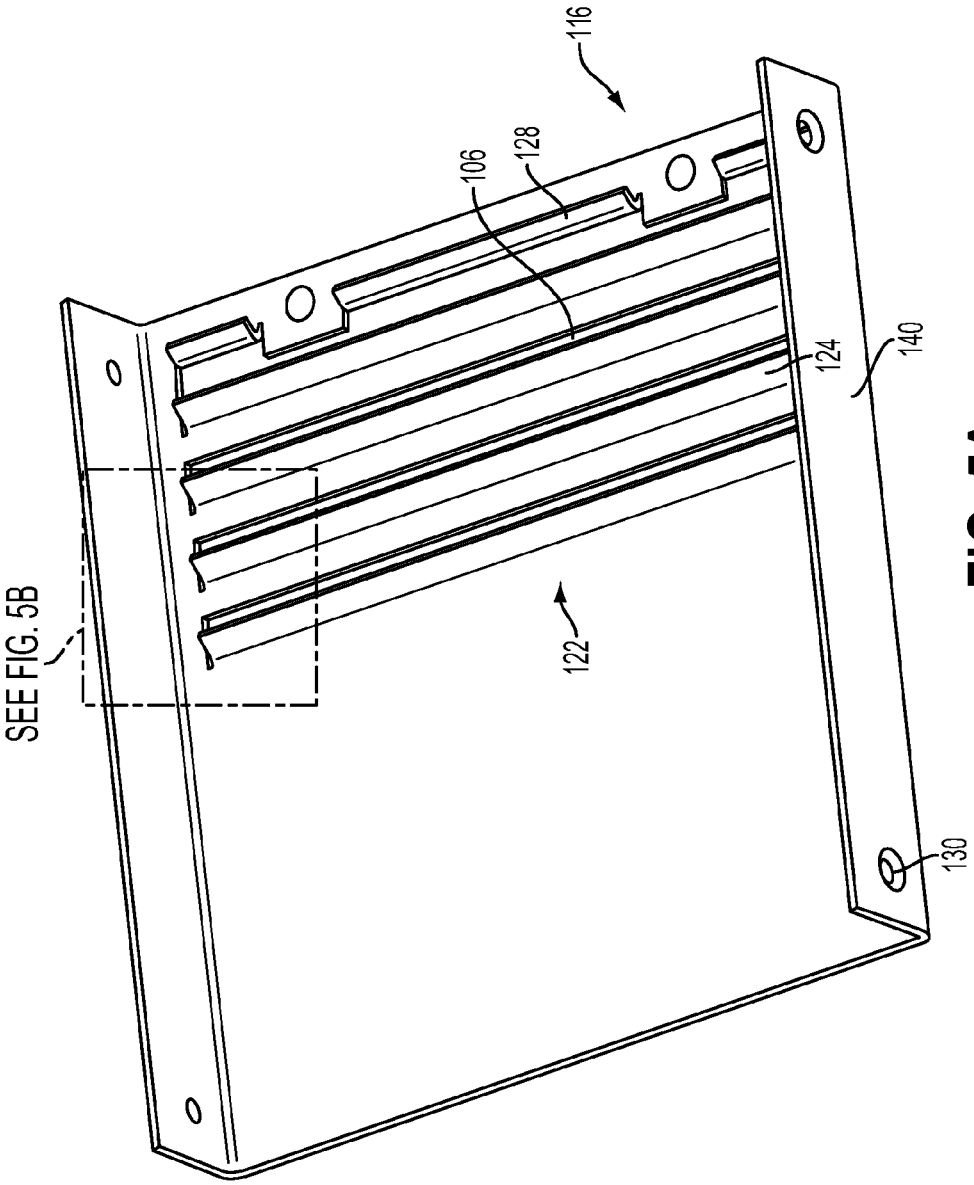
Figure 6:
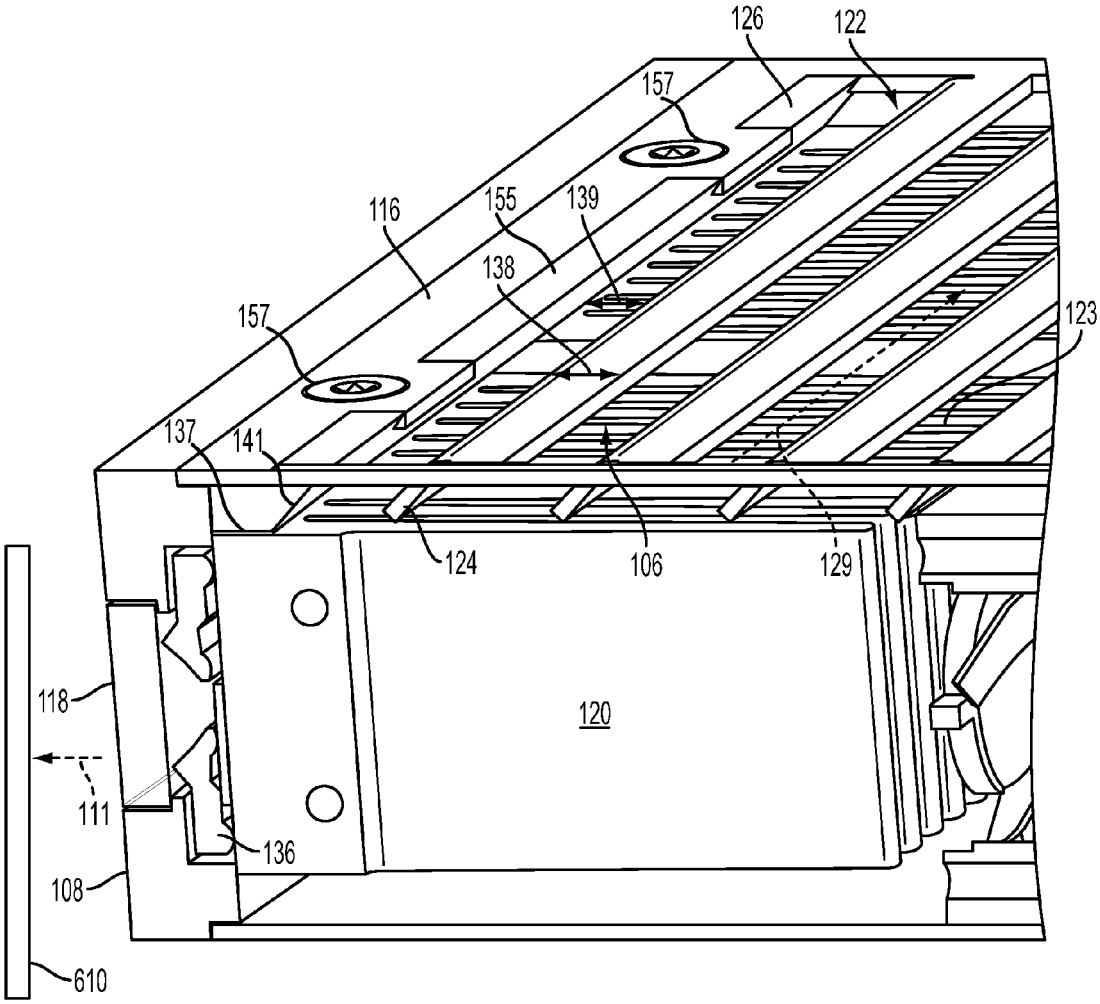
FIG. 6 shows a partial cross-sectional plan view of an example lighting module with louvered vents and heat exits adjacent to a heat sink.
Figure 7:
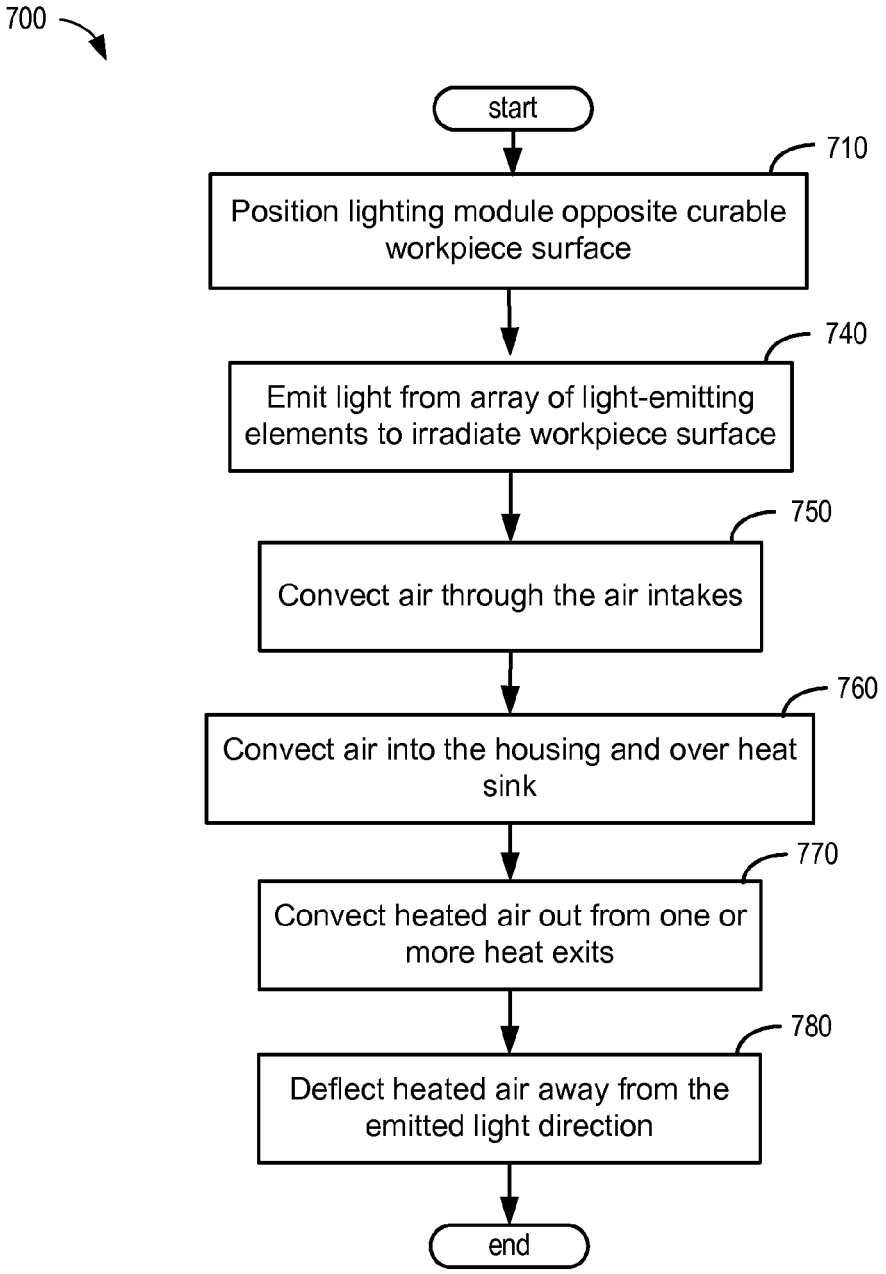
FIG. 7 shows an example flow chart for an example method of irradiating a curable workpiece surface with the lighting module illustrated in FIG. 1.
Figure 8:
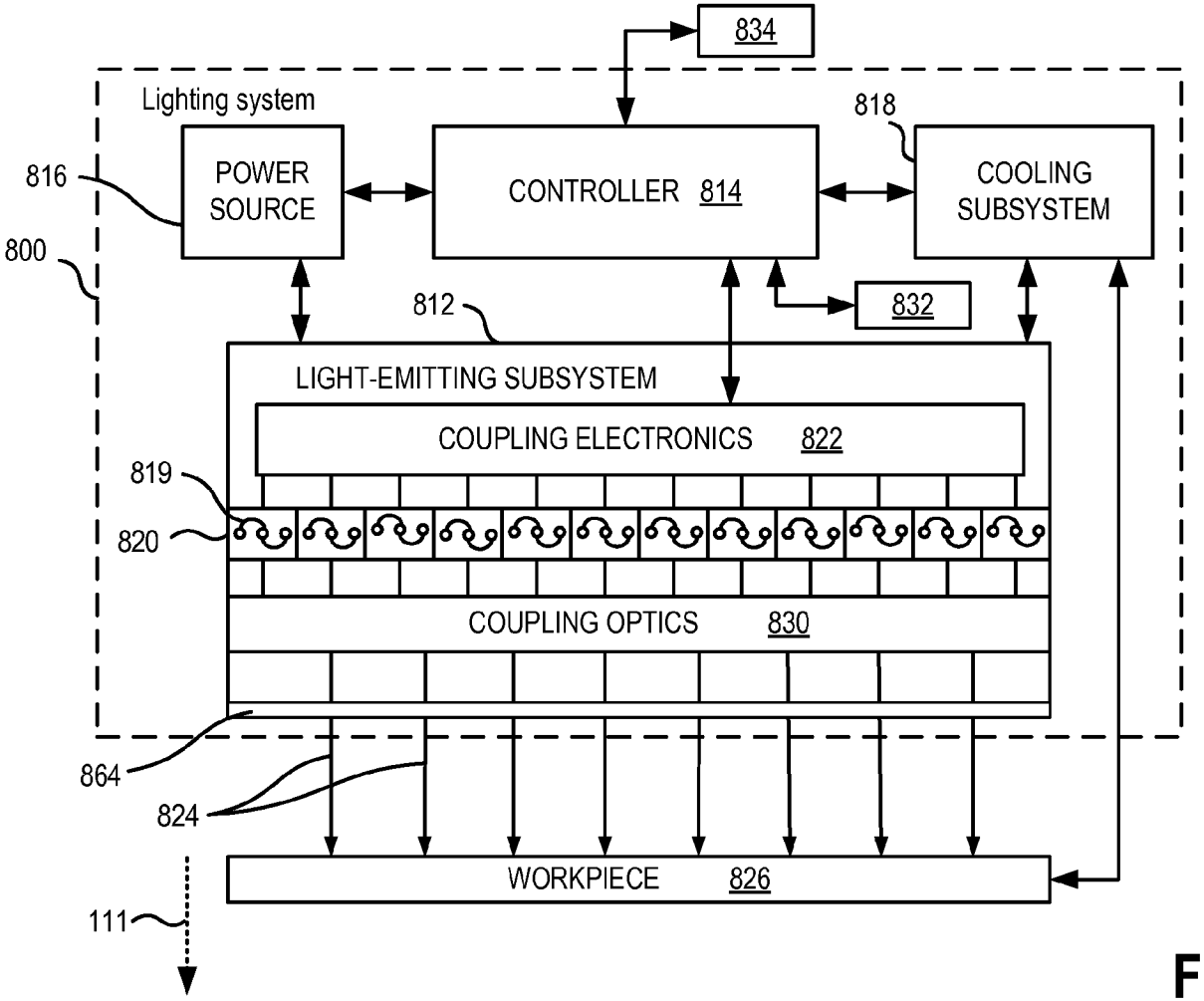
FIG. 8 shows an example schematic of a lighting system.

The present description relates to a lighting module comprising a heat sink for dissipating heat generated from an array of light-emitting elements, and louvered vents for guiding the dissipated heat and airflow away from the lighting module in a deflecting direction away from the emitted light direction. FIGS. 1-2 are front and rear perspective views of an example lighting module comprising louvered vents for guiding airflow and waste heat away from the lighting module. FIG. 3 illustrates a side view of a lighting module showing a deflecting direction of the heated air away from the lighting module. FIG. 4 shows a partial exploded view of components comprising a lighting module with louvered vents of the present disclosure. FIGS. 5A and 5B show a top surface of the housing of a lighting module comprising louvered vents. The louvered vents may be positioned adjacent to the heat sink as shown in FIG. 6. FIGS. 4-6 are drawn to scale while it is appreciated that other suitable scales may be used. A method of irradiating a curable workpiece surface with the lighting module is illustrated in FIG. 7. Finally, FIG. 8 shows an example schematic of a lighting system.

FIGS. 1 and 2 show a lighting module 100 including a housing 102, an array of light-emitting elements 104, and a plurality of heat exits 106. The housing 102 is a rectangular box-shaped structure in this example, but the example housing illustrated in FIGS. 1-2 is not meant to be limiting. As such, housing 102 can be any other suitable size and shape in other lighting module configurations. The housing 102 is a protective structure for housing the array of light-emitting elements 104 and may include any suitable protective materials. The housing 102 in FIGS. 1 and 2 has a front surface 108, a back surface 110, two opposing side surfaces 112, 114, a top surface 116, and a bottom surface (not shown). The front surface 108 includes a window 118 through which the array of light-emitting elements 104 emits light. The window 118 may be positioned on another suitable surface of the housing 102 in other configurations. The window 118 may comprise a glass, plastic or other material suitable to transmit or focus light from the light emitting elements. The window may take on other structural configurations than that shown in FIG. 1. Another structural configuration is shown in the example embodiment of FIGS. 4 and 6.

The window 118 of the lighting module 100 is positioned such that the array of light-emitting elements 104 emit light in an emitted light direction 111 toward a medium with some type of light-curable material, such as a curable workpiece surface. For example, the lighting module 100 is positioned vertically and a substrate, such as paper or plastic, is positioned below the lighting module 100, such that the front surface 108 of the lighting module 100 having the window 118 through which the light is emitted faces the substrate. The curable workpiece surface of the light-curable material is positioned on the substrate so that the emitted light cures the light-curable material when light is emitted through the window 118. The lighting module 100 is movable with respect to the medium in some configurations and may be adjustable in any suitable direction to cure the light-curing material to the medium. The array of light-emitting elements 104 may include light-emitting diodes (LEDs). These LEDs may emit light in a range of wavelengths. For example, the LEDs may emit visible light and ultraviolet light in the range of wavelengths between 10-400 nanometers. Other types of devices may be used as the light-emitting diodes, emitting light of different wavelength ranges depending on the curable workpiece surface.

During the curing process, the array of light-emitting elements 104 may generate a substantial amount of heat when the elements emit light, wherein the heat can damage the lighting module 100. Various heat management systems have been developed to help control the heat generated during this process, such as including one or more heat sinks 120 in the lighting module 100, as seen in FIG. 3 and described later in further detail. The one or more heat sinks 120 included in the lighting module 100 are often positioned to dissipate the heat generated within the housing 102 so that the heat can be expelled through one or more heat exits 106 or other types of openings in the housing 102 of the lighting module 100. For example, the heat sinks 120 may be thermally and/or electrically coupled to the array of light-emitting elements 104. In this manner, heat generated by the array of light-emitting elements may be dissipated by conduction through the heat sinks 120 and by convection and radiation to the air surrounding the external surfaces of heat sinks 120. As an example, the external surface of the heat sinks 120 may be finned, wherein one or more raised fins 123 (seen in FIG. 4) extend from the external surface of the heat sinks 120. The fins 123 increase the external heat transfer surface area of the heat sinks and may help to increase the heat dissipation from the heat sinks 120 as compared to the case of a heat sink with a smooth, unfinned surface.

Furthermore, one or more heat exits 106 may be positioned adjacent to the heat sinks 120, wherein the heat exits 106 comprise openings in top surface 116 of the housing 102. In some examples, the heated air containing the heat dissipated by the heat sink(s) 120 is expelled through the heat exits 106 by a fan or other expulsion device. In other configurations, the heated air is expelled through the heat exits 106 in a passive manner without the use of a fan or any other type of expulsion device. Reference to the expulsion of heat from the housing 102 of the lighting module 100 includes both the active expulsion of the heat by an expulsion device, such as a fan, and the passive expulsion of heat that may not include any type of assistive device to cause the heat to exit the housing 102. Examples of heat exits 106 and an example heat sink 120 are shown in FIGS. 3, 4, and 6.

The heat sink(s) 120 dissipate warm or hot air generated within the housing 102 that then exits the housing 102 through the heat exits 106 or other suitable openings positioned on top surface 116 of the housing 102, as shown in FIGS. 1 and 2. In some examples, the heat sink(s) 120 are spaced apart from, positioned adjacent to, or otherwise considered a discrete element from the heat exits 106. Warm or hot heated air is expelled through the heat exits 106. The combination of heat exits 106 and deflecting surfaces 124 may form a series of louvered vents 122. Without the louvered vents 122 shown in FIGS. 1 and 2, the heated air may be expelled in various directions from the housing 102, including toward the front surface 108 and the window 118 of the housing 102 and thus toward the medium where the curing occurs. When air is allowed to be expelled in the direction of the medium where the curing occurs, it may disrupt the curing process. The louvered vents 122 shown in FIGS. 1 and 2 guide the heated air away from the housing 102 in a direction away from the medium upon which the curing occurs. In these examples, the louvered vents 122 guide the airflow and waste heat away from the housing 102 in a deflecting direction away from the window 118 through which the light is emitted in an emitted light direction 111. Therefore, the heat is expelled away from the medium since the medium is positioned adjacent or otherwise near the window 118. In this way, even if the heat exits are placed near the window 118 of front surface 108, as shown in FIGS. 1-2, disturbances to the curing workpiece surface by the heated air may be substantially reduced by directing the heated air through louvered vents 122.

Turning to FIG. 2, lighting module 100 may further comprise an air intake 103 on its back surface 110, wherein the air intake 103 comprises one or more openings in the housing for convecting air into the lighting module. Furthermore, lighting module 100 may also include an intake cover plate 105. Intake cover plate 105 may define the one or more air intakes 103 for guiding intake air into the housing 102. The intake cover plate may comprise the back surface 110 of the housing 102. As examples, intake air may be convected into housing 102 actively via a fan (not shown) or passively via natural convection.

In alternative embodiments, a fan direction may be reversed and air may be convected out of the lighting module housing, exiting through the back surface 110. The back surface 110 of the housing 102 may further comprise electrical or other inputs. In other embodiments, the back surface 110 may comprise an open grating to allow air access to internal fans (not pictured). Furthermore, different patterns and positioning of the air intake 103 may be possible while remaining within the scope of the present disclosure.

FIG. 3 illustrates a side view of the example lighting module of FIG. 1. As shown by arrow 127, air may enter the lighting module 100 via are intakes 103 at back surface 110. Inside the lighting module, the air may then flow over the heat sinks 120, thereby dissipating the heat generated from the array of light-emitting elements. Although heat sink 120 is located inside housing 102, it is shown with a dashed outline in FIG. 3 to illustrate its positioning inside the housing. The heated air then exits the lighting module via the heat exits 106. The top surface 116 of the housing 102 may be substantially planar as the deflecting surface 124 of the louvered vents 122 is punched into the internal space of the housing 102, leaving the outer shape of the housing substantially unaltered. This generally rectangular exterior shape of the housing 102 may allow for ease of attaching or aligning the lighting module 100 with existing systems.

The louvered vents 122 may guide the heated air away from the housing 102 of the lighting module 100 in a direction that is approximately 180° away from the window 118, essentially in a direction directly opposite the direction of emitted light 111, as shown by the arrow 129 in FIG. 3. This configuration causes the least amount of air to disrupt the curing process because the air flow path directs the air in the opposite direction of the emitted light direction 111 through window 118 on the front surface 108 of the lighting module 100, and thus away from the medium upon which the curing process occurs. However, in alternative examples, the louvered vents 122 may guide the air and waste heat in a direction that is at an angle of at least 90° with respect to the emitted light direction 111 through the window 118, and in other examples, the louvered vents may guide the air and waste heat in a direction that is at an angle of at least 120° with respect to emitted light direction 111 through the window 118. Other angles may be possible while remaining within the scope of the present disclosure.

In another embodiment, air flow through the louvered vents 122 may be intake air that is vented through the back surface 110 by fans that are run in a reverse direction to push air out back surface 110 as opposed to draw it in. In such an embodiment, the direction of airflow through the louvered vents 122 would be opposite to that indicated at 129 in FIG. 3. Furthermore, in the reverse airflow case, the direction of airflow through the air intakes 103 would also be opposite to that indicated at 127.

The louvered vents 122 may have any suitable shape that guides the airflow and waste heat away from the housing 102 of the lighting module 100. The louvered vents 122 may comprise a deflecting surface extending interior to the outer form of the lighting module 100. In other words, the deflecting surface may extend from top surface 116 in the direction of a bottom surface, and may be further angled in the direction of a front surface 108. The louvered vents may each comprise a deflecting surface 124, the deflecting surface extending inward from a plane of top surface 116 of the housing 102 in a diagonal direction toward the window 118 and down toward the heat sink 120. As presented above, louvered vents 122 may include both the solid material of one or more deflecting surfaces 124 and the heat exits 106 that define the lack of material through which air may flow out of lighting module 100, as indicated by arrow 129. This configuration is shown in FIG. 3.

In FIGS. 1-3, the lighting module 100 includes four heat exits 106 and four corresponding louvered vents 122 that direct heat from their respective heat exits 106. In this example, the louvered vents 122 are positioned to extend below each heat exit 106. However, in alternative configurations, the number of louvered vents may vary. The louvered vents may extend along a greater extent of the top surface 116 of the housing 102. The louver vents may further comprise a different shape or dimensions or may be extend from sides 112 and 114 of the housing in multiple segments such that a short un-punched segment may extend from the front surface 108 to the back surface 110 along the length of the louvered vents. Such an embodiment may provide additional structural support to the housing 102 of the lighting module 100 without substantially interfering with air flow through the louvered vents.

Furthermore, the heat exits 106 may be positioned on any surface of the housing 102 of the lighting module 100 in any suitable arrangement. For instance, heat exits 106 and corresponding louvered vents 122 may be placed on front surface 108, back surface 110, two opposing side surfaces 112, 114, top surface 116, and the bottom surface (not shown) of housing 102. As an example, heat exits 106 paired with corresponding louvered vents 122 may be placed very near the array of light-emitting elements 104 because the louvered vents 122 aid in guiding the air and waste heat away from the emitted light direction and the medium or curable workpiece surface. As such, this configuration may reduce the disturbance to the curable workpiece surface caused by the dissipated heat. Furthermore, by placing the heat exits 106 in close proximity to the array of light-emitting elements 104, the heat generated from the array of light-emitting elements may be more expediently dissipated since the heat can be removed via dissipation over a shorter distance as compared to the case where the heat exits 106 are located farther away from the array of light-emitting elements.

The heat exits 106 along with louvered vents 122 may be arranged to most effectively dissipate heat from heat sinks 120 and to expel the heat and air from the housing 102 when the array of light-emitting elements 104 generate heat during use. In some examples, one heat sink 120 is positioned within the housing 102 to dissipate heat generated within the housing, and the dissipated heat may be then expelled during use of the light-emitting elements 104 via the heat sink 120 through heat exits 106.

FIG. 4 shows a partial exploded view of louvered vents 122 within the top surface 116 and the portion of the lighting module 100 to which the top surface 116 is secured. Top surface 116 may be created from a single piece of sheet metal, as an example. The top surface 116 may be formed so that the edges curve down to create corners 140. These corners may serve as attachment points to the sides 114 and 112 (not visible) of the housing 102. Furthermore, the corners may serve as a portion of the sides themselves. Additionally, the louvered vents 122 may be punched out of the raw material forming the top surface 116.

The window 118 may extend fully from one side 112 to the opposite side 114 across the housing 102 of the lighting module 100. With this embodiment of window 118, it may be possible to place multiple lighting module units side by side to create a seamless, elongated light source. In the example of an extended, long curable workpiece surface, such an embodiment may be advantageous. In other examples embodiments, the opposite orientation may be possible where louvered vents 122 are features on the sides 112 and 114 of the housing 102 and window 118 may extend fully from top surface 116 to the bottom surface so that multiple lighting module units may be stacked in a top to bottom fashion to create an extended light emitting surface.

Furthermore, a mounting piece 126 is shown to extend the width of the lighting module 100 from side 112 to side 114. The mounting piece 126 may provide an attachment point between the front surface 108 and the top surface 116 of the housing 102. The mounting piece 126 may provide an airtight seal such that air convected from the heat sink 120 may not be convected onto a workpiece surface through the seam between front surface 108 and top surface 116. The mounting piece 126 may be shaped as shown in FIG. 4 with various indents and ridges 155 to provide a secure structural attachment between the top surface 116 (which includes integral corners 140) and front surface 108.

The mounting piece 126 may have an angled back side that is angled parallel with the louvered vents so that an equivalent vent is created symmetric with the other vents, while at the same time enabling a structural attachment and connection between the top surface 116 and the front surface 108, array and remaining housing portions. The mounting piece 126 may be located on top of heat sink 120 such that the mounting piece is substantially parallel to the top surface of heat sink 120. Furthermore, when lighting module 100 is assembled with mounting piece 126 included, the mounting piece may be in direct contact with front surface 108, top surface 116, side surface 112, side surface 114, and/or the top surface of heat sink 120. As seen in FIG. 4, mounting piece 126 may also include several holes 156 for fixing the mounting piece within housing 102. In this way, mounting piece 126 provides both structural attachment in housing 102 and may also be angled to provide an additional louvered vent to the rest of vents 122. With an angle similar to the angle of louvered vents 122, the mounting piece 126 may contribute to removing heated air from housing 102 generated by light-emitting elements 104 to outside the housing 102 in the deflecting direction.

Turning now to FIG. 5A, an underside of an example component forming the top surface 116 of the housing 102 is illustrated. Corners 140 can be seen positioned at right angles (substantially 90°) to the top surface 116. The deflecting surfaces 124 of the louvered vents 122 extend into what would be an interior space of the housing 102 when top surface 116 is attached to the rest of housing 102. A leading edge 128 of the louvered vents extends in the same direction as the deflecting surfaces 124, but the leading edge may also create an airtight seam with mounting piece 126 (shown in FIG. 4).

FIG. 5B shows a closer view of a portion of FIG. 5A. The width 125 of the deflecting surface 124 is less than or equal to the width 131 of the heat exits 106 as the deflecting surfaces may be formed by punching, pressing, or otherwise forming the deflecting surfaces of the louvered vents out of the raw material that forms the top surface 116 of the housing 102. In other words, top surface 116 may be formed from a continuous piece of sheet metal that is bent to form several geometrical features. For example, corners 140 may be bent from an originally planar position to positions that are substantially 90° to the middle portion of top surface 116. Similarly, the deflecting surfaces 124 may be partially cut from the originally continuous top surface 116 and bent to the angles shown in FIGS. 5A and 5B. In this way, deflecting surfaces 124 include solid material while the empty space left by bending the deflecting surfaces 124 is labeled as heat exits 106.

Leading edge 128 may also be originally part of the continuous piece of sheet metal, wherein cuts and bends are performed to allow leading edge 128 (as well as deflecting surfaces 124) to protrude into the interior of housing 102 when the lighting module 100 is assembled. As seen in FIGS. 5A and 5B, each deflecting surface 124 may be substantially identical in shape and size, while it is appreciated that other configurations are possible. For example, the width 125 of deflecting surfaces 124 may gradually increase with each deflecting surface that is farther away from leading edge 128. Furthermore, bolt holes 130 may be cut into the sheet metal forming top surface 116 for ease of assembly. Other methods of attaching the components of the housing 102 are possible such as gluing, nailing, welding, and riveting, provided as examples.

Turning now to FIG. 6, a partial cross-sectional view of a lighting module 100 is shown. The cross section is taken parallel to sides 112 and 114 as viewed from side 114. As shown in FIG. 6, louvered vents 122 may extend over at least a portion of heat exits 106, and heat exits 106 are positioned adjacent to heat sink 120. Heat sink 120 may include a plurality of fins 123 and may be thermally and/or electrically coupled to an array of light-emitting elements (not visible). A reflector clamp 136 may be used to hold the light-emitting elements to the heat sink 120. The width 139 of heat exits 106 may be the same as the width 138 of the portions of top surface 116 segregating the heat exits.

The fins 123 of the heat sink 120 may be arranged so that the ridges and grooves of the fins extend from front surface 108 to a back surface (not shown) of the housing. In other words, the fins 123 of the heat sink 120 may be parallel to sides 112 and 114 of the housing. The array of light-emitting elements may emit light in an emitted light direction 111, and louvered vents 122 may guide dissipated heat and/or heated air in a deflecting direction 129 at least 90° from the emitted light direction 111.

Mounting piece 126 is also visible in FIG. 6, wherein the mounting piece is shown in the assembled configuration providing structural support for housing 102. It can be seen that recesses and ridges 155 of mounting piece 126 may maintain face-sharing contact with tabs and other features of top surface 116 in order to form a rigid assembly as well as an air-tight seal between the interior of housing 102 and the exterior of the housing. Furthermore, fasteners 157 may be inserted through the holes of top surface 116 as well holes 156 of the mounting piece 126 in order to secure the assembly of lighting module 100. In one example, fasteners 157 may thread into only mounting piece 126 while in another example fasteners 157 may thread into heat sink 120 in order to fix top surface 116 and the mounting piece to heat sink 120. The end surfaces of mounting piece 126 may be coplanar with the end surfaces of heat sink 120.

Mounting piece 126 has a cross-sectional geometry as seen in FIG. 6, wherein a horizontal edge 137 is substantially planar to the top surface 116. Also, a leading edge 141 is angled, extending from horizontal edge 137 to top surface 116. Leading edge 141 may have an angle ranging between 0° and 90°. In some examples, leading edge 141 may be substantially parallel to deflecting surfaces 124, as seen in FIG. 6. In other words, leading edge 141 may share the same angle as deflecting surfaces 124. In this way, leading edge 141 further guides heated air from heat sink 120 out of the interior of housing 102 in the deflecting direction 129. As one function, mounting piece 126 may aid in providing structural support for housing 102 and provide connection between top surface 116, front surface 108, and heat sink 120, among other components. Additionally, as a second function, mounting piece 126 may act as another deflecting surface of louvered vents 122 by angling leading edge 141 in a similar fashion to the other deflecting surfaces 124. In this sense, leading edge 141 is the first deflecting surface closest to front surface 108, and leading edge 141 is located prior to the start of louvered vents 122 and fins 123.

As seen in FIG. 6, four louvered vents 122 are included in top surface 116, wherein each louvered vent includes four heat exits 106 and four deflecting surfaces 124. As seen, the louvered vents 122 do not extend beyond the end of heat sink 120 farther away from front surface 108. In particular, the fourth deflecting surface 124 from front surface 108 may be proximate to the ends of fins 123. In other words, most rearward of the louvered vents 122 may have its deflecting surface 124 substantially aligned with the rearward end of the heat sink 120. This alignment may allow for heated air vented by the heat sink 120 to escape the heat exits 106. In some configurations, the louvered vents 122 may not extend further in the direction of the back surface than the rearward end of heat sink 120. With this configuration of alignment between the deflecting surface 124 and heat sink 120, air flown into housing 102 may be directed into heat sink 120 before exiting the housing via louvered vents 122. If additional louvered vents 122 extended beyond fins 123, then air flown into housing 102 may exit prior to transferring heat from heat sink 120, which may degrade heat exchange performance.

In the present configuration shown in FIG. 6, substantially all of the intake air may be directed through fins 123 without letting air escape through louvered vents 122 before interaction with heat sink 120, thereby increasing heat exchange efficiency. Additionally, deflecting surfaces 124 may be in close proximity to fins 123 such that a small gap is present between the deflecting surfaces and fins. As such, intake air may flow through fins 123 and directly out through heat exits 106 without recirculating through heat sink 120. In this way, heat exchange between the intake air and heat sink 120 may be optimized to increase overall performance of lighting module 100. Alternatively, if large spaces were present between fins 123 and deflecting surfaces 124, then air may flow along the tops of fins 123 and recirculate away from front surface 108. This air flow may decrease heat exchange performance and efficiency of the lighting module 100.

Also shown in FIG. 6 is an example of a curable workpiece surface 610. The lighting module 100 may be positioned so that window 118 faces the curable workpiece surface 610. In this manner, light emitted from the array of light-emitting elements in an emitted light direction 111 may irradiate the curable workpiece surface 610.

Turning now to FIG. 7, an example method 700 of irradiating a curable workpiece surface with the lighting module 100 of previous figures is shown. For ease of understanding, reference will be made to labeled components of FIGS. 1-6. Method 700 begins at 710 where a lighting module is positioned opposite a curable workpiece surface. For example, lighting module 100 may be placed so that window 118 faces the curable workpiece surface. As shown in FIG. 6, light may be emitted from the array of light-emitting elements in an emitted light direction 111 to irradiate the curable workpiece surface at 740. Next, at 750, air may be actively or passively convected through the air intakes 103 as seen by direction 127 in FIG. 3. The convected air is then passed into the housing 102 and over the one or more heat sinks 120 at 760. Heat generated from the array of light-emitting elements 104 is dissipated via conduction to the heat sinks 120 and then further dissipated by conduction and radiation to the air convected over the external surface of the heat sinks 120. If the heat sinks 120 are finned, then the heat transfer area and the heat transfer dissipation rate may be increased as compared to when the heat sinks 120 are not finned.

Next, method 700 continues at 770 where the heat and/or heated air is convected out from the heat exits 106. In cases where housing 102 comprises louvered vents 122 that may extend at least partially over the heat exits 106, the heated air may be deflected away from the emitted light direction 111 in a deflecting direction 129 at 780 (as seen in FIG. 3). As an example, the deflecting direction 129 may be at least 90° away from the emitted light direction. Upon completion of 780, method 700 ends.

Turning now to FIG. 8, a block diagram for an example configuration of a lighting system 800 for a lighting module 100 is illustrated. In one example, lighting system 800 may comprise a lighting module 100 comprising a light-emitting subsystem 812, a controller 814, a power source 816, and a cooling subsystem 818. The light-emitting subsystem 812 may comprise a plurality of semiconductor devices 819. The plurality of semiconductor devices 819 may be an array 820 of light-emitting elements such as a linear or two-dimensional array of LED devices, for example. The plurality of semiconductor devices 819 may provide radiant output 824, represented by the arrows in FIG. 8. The radiant output 824 may be directed in an emitted light direction 111 to a workpiece 826 located at a fixed plane from lighting system 800.

The radiant output 824 may be directed to the workpiece 826 via coupling optics 830. The coupling optics 830, if used, may be variously implemented. As an example, the coupling optics 830 may include one or more layers, materials or other structures interposed between the semiconductor devices 819 and window 864 in order to direct radiant output 824 to surfaces of the workpiece 826. As an example, the coupling optics 830 may include a micro-lens array to enhance collection, condensing, or collimation of radiant output 824, or otherwise enhance the quality or effective quantity of the radiant output. As another example, the coupling optics 830 may include a micro-reflector array. In employing such a micro-reflector array, each semiconductor device 819 providing radiant output 824 may be disposed in a respective micro-reflector, on a one-to-one basis. As another example, a linear array 820 of semiconductor devices 819 providing radiant output 824 may be disposed in macro-reflectors, on a many-to-one basis. In this manner, coupling optics 830 may include both micro-reflector arrays, wherein each semiconductor device 819 is disposed on a one-to-one basis in a respective micro-reflector, and macro-reflectors wherein the quantity and/or quality of the radiant output 824 from the semiconductor devices is further enhanced by macro-reflectors.

Each of the layers, materials, or other structure of coupling optics 830 may have a selected index of refraction. By properly selecting each index of refraction, reflection at interfaces between layers, materials, and other structures in the path of the radiant output 824 may be selectively controlled. As an example, by controlling differences in such indexes of refraction at a selected interface, for example window 864, disposed between the semiconductor devices 819 and the workpiece 826, reflection at that interface may be reduced or increased so as to enhance the transmission of radiant output 824 at that interface for ultimate delivery to the workpiece 826. For example, the coupling optics may include a dichroic reflector wherein certain wavelengths of incident light are absorbed while other wavelengths are reflected and focused to the surface of workpiece 826.

The coupling optics 830 may be employed for various purposes. Example purposes include, among others, to protect the semiconductor devices 819, to retain cooling fluid associated with the cooling subsystem 818, to collect, condense and/or collimate the radiant output 824, or for other purposes, alone or in combination. As a further example, the lighting system 800 may employ coupling optics 830 so as to enhance the effective quality, uniformity, or quantity of the radiant output 824, particularly as delivered to the workpiece 826.

Several or all of the plurality of semiconductor devices 819 may be coupled to the controller 814 via coupling electronics 822 so as to provide data to the controller 814. As described further below, the controller 814 may also be implemented to control such data-providing semiconductor devices 819, e.g., via the coupling electronics 822. The controller 814 may also be connected to, and may be implemented to control, the power source 816 and the cooling subsystem 818. For example, the controller 814 may supply a larger drive current to light-emitting elements distributed in the middle portion of linear array 820 and a smaller drive current to light-emitting elements distributed in the end portions of linear array 820 in order to increase the useable width of light irradiated at workpiece 826. Moreover, the controller 814 may receive data from power source 816 and cooling subsystem 818. In one example, the irradiance at one or more locations at the workpiece 826 surface may be detected by sensors and transmitted to controller 814 in a feedback control scheme. In a further example, controller 814 may communicate with a controller of another lighting system (not shown in FIG. 8) to coordinate control of both lighting systems. For example, controllers 814 of multiple lighting systems may operate in a master-slave cascading control algorithm, where the setpoint of one of the controllers is set by the output of the other controller. Other control strategies for operation of lighting system 800 in conjunction with another lighting system may also be used. As another example, controllers 814 for multiple lighting systems arranged side by side may control lighting systems in an identical manner for increasing uniformity of irradiated light across multiple lighting systems.

In addition to the power source 816, cooling subsystem 818, and light-emitting subsystem 812, the controller 814 may also be connected to and implemented to control internal element 832 and external element 834. Element 832, as shown, may be internal to the lighting system 800, while element 834, as shown, may be external to the lighting system 800, but may be associated with the workpiece 826 (e.g., handling, cooling or other external equipment) or may be otherwise related to a photoreaction (e.g. curing) that lighting system 800 supports.

The data received by the controller 814 from one or more of the power source 816, the cooling subsystem 818, the light-emitting subsystem 812, and/or elements 832 and 834, may be of various types. As an example the data may be representative of one or more characteristics associated with coupled semiconductor devices 819. As another example, the data may be representative of one or more characteristics associated with the respective light-emitting subsystem 812, power source 816, cooling subsystem 818, internal element 832, and external element 834 providing the data. As still another example, the data may be representative of one or more characteristics associated with the workpiece 826 (e.g., representative of the radiant output energy or spectral component(s) directed to the workpiece). Moreover, the data may be representative of some combination of these characteristics.

The controller 814, in receipt of any such data, may be implemented to respond to that data. For example, responsive to such data from any such component, the controller 814 may be implemented to control one or more of the power source 816, cooling subsystem 818, light-emitting subsystem 812 (including one or more such coupled semiconductor devices), and/or the elements 32 and 34. As an example, responsive to data from the light-emitting subsystem 812 indicating that the light energy is insufficient at one or more points associated with the workpiece 826, the controller 814 may be implemented to either (a) increase the power source's supply of power to one or more of the semiconductor devices 819, (b) increase cooling of the light-emitting subsystem via the cooling subsystem 818 (e.g., certain light-emitting devices, if cooled, provide greater radiant output), (c) increase the time during which the power is supplied to such devices, or (d) a combination of the above.

Individual semiconductor devices 819 (e.g., LED devices) of the light-emitting subsystem 812 may be controlled independently by controller 814. For example, controller 814 may control a first group of one or more individual LED devices to emit light of a first intensity, wavelength, and the like, while controlling a second group of one or more individual LED devices to emit light of a different intensity, wavelength, and the like. The first group of one or more individual LED devices may be within the same linear array 820 of semiconductor devices, or may be from more than one linear array of semiconductor devices 820 from multiple lighting systems 800. Linear array 820 of semiconductor devices 819 may also be controlled independently by controller 814 from other linear arrays of semiconductor devices in other lighting systems. For example, the semiconductor devices of a first linear array may be controlled to emit light of a first intensity, wavelength, and the like, while those of a second linear array in another lighting system may be controlled to emit light of a second intensity, wavelength, and the like.

As a further example, under a first set of conditions (e.g. for a specific workpiece, photoreaction, and/or set of operating conditions) controller 814 may operate lighting system 800 to implement a first control strategy, whereas under a second set of conditions (e.g. for a specific workpiece, photoreaction, and/or set of operating conditions) controller 814 may operate lighting system 800 to implement a second control strategy. As described above, the first control strategy may include operating a first group of one or more individual semiconductor devices (e.g., LED devices) to emit light of a first intensity, wavelength, and the like, while the second control strategy may include operating a second group of one or more individual LED devices to emit light of a second intensity, wavelength, and the like. The first group of LED devices may be the same group of LED devices as the second group, and may span one or more arrays of LED devices, or may be a different group of LED devices from the second group, but the different group of LED devices may include a subset of one or more LED devices from the second group.

The cooling subsystem 818 may be implemented to manage the thermal behavior of the light-emitting subsystem 812. For example, the cooling subsystem 818 may provide for cooling of light-emitting subsystem 812, and more specifically, the semiconductor devices 819. For example, cooling subsystem 818 may comprise an air or other fluid (e.g., water) cooling system. Cooling subsystem 818 may also include cooling elements such as cooling fins attached to the semiconductor devices 819, or linear array 820 thereof, or to the coupling optics 830. For example, cooling subsystem may include blowing cooling air over the coupling optics 830, wherein the coupling optics 830 are equipped with external fins to enhance heat transfer. Cooling subsystem 818 may further comprise one or more louvered vents 122 and/or one or air intakes 103. As described above, louvered vents 122 may aid in guiding dissipated heat and/or heated air away from the housing 102 in a deflected direction 129 away from an emitted light direction 111, for example, at least 90° away from an emitted light direction 111. As described above, air intakes 103 may aid in guiding intake air into the housing 102, wherein the intake air is subsequently guided in a deflected direction 129 away from the emitted light direction 111 and away from the curable workpiece surface or workpiece 826.

The lighting system 800 may be used for various applications. Examples include, without limitation, curing applications ranging from ink printing to the fabrication of DVDs and lithography. The applications in which the lighting system 800 may be employed can have associated operating parameters. That is, an application may have associated operating parameters as follows: provision of one or more levels of radiant power, at one or more wavelengths, applied over one or more periods of time. In order to properly accomplish the photoreaction associated with the application, optical power may be delivered at or near the workpiece 826 at or above one or more predetermined levels of one or a plurality of these parameters (and/or for a certain time, times or range of times).

In order to follow an intended application's parameters, the semiconductor devices 819 providing radiant output 824 may be operated in accordance with various characteristics associated with the application's parameters, e.g., temperature, spectral distribution and radiant power. At the same time, the semiconductor devices 819 may have certain operating specifications, which may be associated with the semiconductor devices' fabrication and, among other things, may be followed in order to preclude destruction and/or forestall degradation of the devices. Other components of the lighting system 800 may also have associated operating specifications. These specifications may include ranges (e.g., maximum and minimum) for operating temperatures and applied electrical power, among other parameter specifications.

Accordingly, the lighting system 800 may support monitoring of the application's parameters. In addition, the lighting system 800 may provide for monitoring of semiconductor devices 819, including their respective characteristics and specifications. Moreover, the lighting system 800 may also provide for monitoring of selected other components of the lighting system 800, including its characteristics and specifications.

Providing such monitoring may enable verification of the system's proper operation so that operation of lighting system 800 may be reliably evaluated. For example, lighting system 800 may be operating improperly with respect to one or more of the application's parameters (e.g. temperature, spectral distribution, radiant power, and the like), any component's characteristics associated with such parameters and/or any component's respective operating specifications. The provision of monitoring may be responsive and carried out in accordance with the data received by the controller 814 from one or more of the system's components.

Monitoring may also support control of the system's operation. For example, a control strategy may be implemented via the controller 814, the controller 814 receiving and being responsive to data from one or more system components. This control strategy, as described above, may be implemented directly (e.g., by controlling a component through control signals directed to the component, based on data respecting that components operation) or indirectly (e.g., by controlling a component's operation through control signals directed to adjust operation of other components). As an example, a semiconductor device's radiant output may be adjusted indirectly through control signals directed to the power source 816 that adjust power applied to the light-emitting subsystem 812 and/or through control signals directed to the cooling subsystem 818 that adjust cooling applied to the light-emitting subsystem 812.

Control strategies may be employed to enable and/or enhance the system's proper operation and/or performance of the application. In a more specific example, control may also be employed to enable and/or enhance balance between the linear array's radiant output and its operating temperature, so as, e.g., to preclude heating the semiconductor devices 819 beyond their specifications while also directing sufficient radiant energy to the workpiece 826, for example, to carry out a photoreaction of the application.

In some applications, high radiant power may be delivered to the workpiece 826. Accordingly, the light-emitting subsystem 812 may be implemented using a linear array 820 of light-emitting semiconductor devices 819. For example, the light-emitting subsystem 812 may be implemented using a high-density, light-emitting diode (LED) array. Although LED arrays may be used and are described in detail herein, it is understood that the semiconductor devices 819, and linear arrays 820 thereof, may be implemented using other light-emitting technologies without departing from the principles of the invention; examples of other light-emitting technologies include, without limitation, organic LEDs, laser diodes, other semiconductor lasers.

It will be appreciated that variations of the above-disclosed lighting modules and other features and functions, or alternatives thereof, may be desirably combined into many other different systems, methods, or applications. For example, methods of guiding air or heat away from a lighting module may use anyone or more of the above disclosed louvered vents. Also various presently unforeseen or unanticipated alternatives, modifications, variations, or improvements therein may be subsequently made by those skilled in the art which also are intended to be encompassed by the following claims. Thus, although there has been described to this point a particular embodiment for a method and apparatus for lighting modules with louvered vents, it is not intended that such specific references be considered as limitations upon the scope of this invention except in-so-far as set forth in the following claims.

Various alternative scopes of coverage may be desired. In example, a lighting module, comprises a housing with a surface perpendicular to a vertical axis of the module, the surface including a plurality of lateral louvered vents; an array of light-emitting elements arranged on a planar substrate and positioned behind a planar window, the planar window optionally including one or more lenses or other light-modifying features, the window extending fully across the housing such that the window extend laterally at least as wide as a widest part of the housing; and a heat sink thermally coupled to the array of light-emitting elements, the heat sink including a plurality of extending longitudinal fins with vertical spaces therebetween, the plurality of louvered vents optionally all positioned vertically above the longitudinally extending fins.

The lighting module may further comprise a fan positioned immediately behind the fins and facing the window, the fan positioned longitudinally behind a last of the vents. The lighting module may further comprise power electronics positioned behind the fan. The lighting module may further have the vents include an extension into an inside of the housing. The lighting module may further have the array of light-emitting elements being a single linear array of LEDs. The lighting module may further have no components between a top surface of the heat sink fins and the louvered vents. The lighting module may further have the substrate is mounted directly to the heat sink with no components therebetween, and wherein the substrate is powered by power electronics. The lighting module may further have the module positioned in an ink-curing system, such as a printer, or a sterilization system, or a fiber-curing system. For example, the lighting module may be positioned proximate to a fiber optic cable for generating UV light to cure the cable as it passes by the module. As another example, the lighting module may be positioned proximate to components to be sterilized, such as blood containers, etc.

The invention claimed is:

1. A lighting module, comprising:

an array of light-emitting elements;

a heat sink thermally coupled to the array of light-emitting elements;

a housing containing the array of light-emitting elements;

a plurality of heat exits from a first side of the housing, the plurality of heat exits opening adjacent to the heat sink; and a plurality of louvered vents punched into the housing and extending below the plurality of heat exits, the plurality of louvered vents shaped to guide heat away from the plurality of heat exits in a deflecting direction away from an emitted light direction that light is emitted toward.

2. The lighting module of claim 1, wherein the array of light-emitting elements are positioned adjacent to and facing a front window of the housing, and wherein the array of light-emitting elements emit light through the front window in the emitted light direction.

3. The lighting module of claim 1, wherein the plurality of louvered vents comprise a deflecting surface, the deflecting surface punched inward from a plane of a top surface of the housing.

4. The lighting module of claim 1, wherein the deflecting direction includes a direction opposite the emitted light direction.

5. The lighting module of claim 1, wherein the first side comprises a side of the housing different from a front side of the housing, the front side of the housing containing a front window.

6. The lighting module of claim 1, wherein the first side comprises a top surface of the housing.

7. A lighting module, comprising:

an array of light-emitting elements;

a heat sink thermally coupled to the array of light-emitting elements;

a housing containing the array of light-emitting elements, the array of light-emitting elements emitting light through a front window of the housing in an emitted light direction;

a plurality of heat exits from the housing, the plurality of heat exits opening adjacent to the heat sink; and a plurality of louvered vents corresponding to the plurality of heat exits, the plurality of louvered vents punched inward from the housing and extending internal to the housing from the plurality of heat exits, the plurality of louvered vents shaped and angled to guide heat away from the plurality of heat exits in a deflecting direction.

8. The lighting module of claim 7, wherein the plurality of louvered vents each comprise a deflecting surface, the deflecting surface extending interior to the housing from a plane of a top surface of the housing in a diagonal direction toward the window and the heat sink.

9. The lighting module of claim 8, wherein the top surface of the housing is substantially planar.

10. A lighting module, comprising:

a housing with a surface perpendicular to a vertical axis of the module, the surface including a plurality of lateral louvered vents;

an array of light-emitting elements arranged on a planar substrate and positioned behind a planar window, the planar window including one or more lenses or other light-modifying features, the window extending fully across the housing such that the window extends laterally at least as wide as a widest part of the housing;

a heat sink thermally coupled to the array of light-emitting elements, the heat sink including a plurality of extending longitudinal fins with vertical spaces therebetween, the plurality of louvered vents all positioned vertically above the longitudinally extending fins; and wherein the plurality of louvered vents in the housing extend below a plurality of heat exits, the plurality of louvered vents shaped to guide heat away from the plurality of heat exits in a deflecting direction away from an emitted light direction that light is emitted toward.

11. The lighting module of claim 10, further comprising a fan positioned immediately behind the fins and facing the window, the fan positioned longitudinally behind a last of the louvered vents.

12. The lighting module of claim 10, further comprising power electronics positioned behind a fan.

13. The lighting module of claim 10, wherein the louvered vents include an extension into an inside of the housing.

14. The lighting module of claim 10, wherein the array of light-emitting elements includes a single linear array of light-emitting diodes (LEDs).

15. The lighting module of claim 10, wherein there are no components between a top surface of the heat sink fins and the louvered vents.

16. The lighting module of claim 10, wherein the substrate is mounted directly to the heat sink with no components therebetween, and wherein the substrate is powered by power electronics.

17. The lighting module of claim 10, wherein the module is positioned in an ink-curing system, a sterilization system, or a fiber-curing system.

18. The lighting module of claim 10, further comprising a mounting piece that provides an attachment point between a front surface and top surface of the housing.

19. The lighting module of claim 18, wherein the mounting piece includes various indents, ridges, and holes to provide structural attachment between the top surface and front surface of the housing.

20. The lighting module of claim 10, further comprising a controller, a power source, and a cooling subsystem.

* * * * *